US006089827A

United States Patent [19]

Ichiryu et al.

[11] Patent Number: 6,089,827

[45] Date of Patent: Jul. 18, 2000

[54] ROTOR FOR GAS TURBINES

[75] Inventors: Taku Ichiryu; Koichi Akagi; Yasuoki Tomita, all of Takasago, Japan

[73] Assignee: Mitsubishi Heavy Industries, Ltd., Tokyo, Japan

[21] Appl. No.: 09/242,108

[22] PCT Filed: Jun. 10, 1998

[86] PCT No.: PCT/JP98/02564

§ 371 Date: Feb. 9, 1999

§ 102(e) Date: Feb. 9, 1999

[87] PCT Pub. No.: WO98/57040

PCT Pub. Date: Dec. 17, 1998

[30] Foreign Application Priority Data

Jun. 11, 1997 [JP] Japan ..... 9-153703
Jun. 30, 1997 [JP] Japan ..... 9-174097

[51] Int. Cl.[7] ..... B63H 1/00

[52] U.S. Cl. ..... 416/198 A; 415/230; 416/248

[58] Field of Search ..... 415/176, 230; 416/198 A, 248

[56] References Cited

FOREIGN PATENT DOCUMENTS 48-25686 7/1973 Japan .
6-81675 3/1994 Japan .
7-324632 12/1995 Japan .
9-242505 9/1997 Japan .

*Primary Examiner*—Edward K. Look
*Assistant Examiner*—Hermes Rodriquez
*Attorney, Agent, or Firm*—Wenderoth, Lind & Ponack, L.L.P.

[57] ABSTRACT

A gas turbine rotor, in which a plurality of discs having teeth of a bevel gear are juxtaposed to engage the teeth and are integrally fastened by a bolt extending through the discs, so that the discs may be cooled by feeding cooling air to the air passages of the individual discs sequentially at the running time, is provided whereby the cooling air is prevented from leaking by means having no wear. Radially outward of an air passage through hole of the faces of the adjoining discs, there are provided arms which are made lower than the dedendums of the teeth and protruded in an annular shape to confront each other; one of the arms has a tip made to have an elastically deformable thickness and a sectional shape bent inward or outward, whereas there is welded to the other arm an extension which has a tip made to have an elastically deformable thickness and a sectional shape bent inward or outward; and the end face of the tip of the one arm and the end face of the tip of the extension of the other arm are held in abutment against each other so that the two end faces may be forced, when the discs are integrated, into contact with each other to prevent leakage of cooling air.

2 Claims, 9 Drawing Sheets

ROTOR FOR GAS TURBINES

TECHNICAL FIELD

The present invention relates to a gas turbine rotor.

BACKGROUND OF THE INVENTION

FIG. 4 is a longitudinal section showing one example of the gas turbine of the prior art; FIG. 5 is a partially enlarged longitudinal section of the same gas turbine; and FIG. 6 is an enlarged view of a V portion of FIG. 5. In these figures: reference numeral 12 designates discs of a rotor; numeral 13 a bolt jointing the individual discs; numeral 14 teeth for engaging the adjoining discs; numeral 15 annular arms mounted on the opposed portions of the adjoining discs; numeral 16 a sealing plate mounted between the paired arms; numeral 17 an air passage formed in the discs; numeral 18 an air inlet; numeral 19 a cooling air inflow; numeral 20 flows of the cooling air between the discs.

In the ordinary gas turbine, a plurality of discs 12 having moving blades 11 embedded thereon are axially juxtaposed and fastened by the bolt 13 to construct a rotor, and their joint faces form teeth 14 so as to correspond to bevel gears having an apex angle of 180 degrees and are engaged to transmit a torque and to align the discs. Each disc has the air passage 17 through which the air flow 20 is fed to cool the discs 12 and the roots of the moving blades 11.

FIG. 6 presents diagrams for explaining the working of the teeth 14 formed in the disc 12. FIG. 6 presents a longitudinal section of the disc at (a), a section B—B of (a) at (b), and a section C—C of (b) at (c). FIG. 6 illustrates at (b) and (c) a disc-shaped grinding stone 25 for cutting the teeth 14. Reference numeral 26 designates tooth generating faces formed on the grinding stone. Reference letter H designates the distance between the teeth 14 and the arm 15, and letter R designates the radius of the grinding stone 25.

In order to minimize the wear for one grinding cycle thereby to keep the accuracy, the grinding stone 25 is generally exemplified by a radially large disc-shaped grinding stone 25, the radius of which is larger than the distance H between the teeth 14 and the arm 15. The protrusion of the arm 15 has to be so high as not to obstruct the rotation of the radially large grinding stone.

FIG. 7 is an enlarged view of the tips of the arms of the paired discs, i.e., the V portion of FIG. 5. In order to keep the radially large grinding stone away from contact with the end face 15*a* of the arm while the tooth generating face 26 of the radially large grinding stone is turning to cut the dedendum of the tooth 14, the arm end face 15*a* is retracted from a pitch line 21 by a size corresponding to a stone relief 22. This establishes a clearance corresponding to at least a clearance 23 between the end faces 15*a* of the paired arms. The aforementioned sealing plate 16 is provided for preventing the cooling air from flowing out of the clearance to the outer circumference and is a cover for sealing the clearance between the two end faces of the paired arms. This sealing plate 16 is fitted in the grooves which are formed in the opposed end faces 15*a* of the arms 15. The sealing plate 16 takes a ring shape, after mounted, by preparing the ring with halves or quarters for the working conveniences and by fitting them individually.

Other examples of the prior art are described with reference to FIGS. 9 and 10.

In the example shown in FIG. 9, cooling air 41 having passed a stator blade 40 flows, as indicated by arrows, out of a hole 42 formed in the upstream side of the inner end of the stator blade 40, and is fed through a labyrinth 43 at the apex of the stator blade to the blade root 45 of a moving blade 44 so that it may be used for the cooling purpose.

That is, in this type, the flow of the cooling air to the blade root 45 depends upon the difference in the static pressure between the upstream and downstream sides of the blade root 45. This makes it necessary to raise the static pressure upstream of the moving blade 44 or to lower the same downstream of the moving blade 44.

In the other type shown in FIG. 10, there is added to the foregoing construction of FIG. 9 a nozzle 46 which is opened in the inner circumference of the stator blade 40 and directed downstream, so that the cooling air may be easily fed to the root 45 of the moving blade 44 by injecting it additionally from the nozzle 46.

The flow of the cooling air to be injected from the nozzle 46 is shown at (b) in FIG. 10 presenting a D—D section of (a) of FIG. 10. If the nozzle 46 has an injection angle (,the moving blade 44 has a circumferential velocity u, and the cooling air has an injection velocity c, a velocity triangle can be formed, as shown at (b) in FIG. 10, to determine an inflow velocity w.

However, although this inflow velocity w is summed, in this type, the flow of the cooling air to be fed to the blade root 45 is also based on the static pressure difference between the upstream and downstream sides at the root 45 of the moving blade 44.

DISCLOSURE OF THE INVENTION

In the gas turbine structure in the prior art thus far described, the rotor is horizontally arranged so that its center line 24 warps by its own weight, as shown in FIG. 8. As a result, the clearances between the outer circumferences of the individual discs are different between the upper and lower sides so that one clearance changes by the differences for each turn if one point on its circumference is noted. In other words, the fitting grooves of the sealing sheet axially slide, although slightly, for each turn. The sealing plate continues its sliding motions while being pushed on the grooves by the centrifugal force, so that it wears after a long run.

For the working conveniences, on the other hand, the sealing plate is made of the halved or quartered ring so that a leakage occurs at the split portions. Although this leakage at the split portions can be eliminated if the ring is made to have no joint, it raises the cost to work a thin disc of large radius in high accuracy and is improper for the practical use The invention contemplates to eliminate the defects of such examples of the prior art and to provide a gas turbine rotor which is equipped with seal means having a sealing portion freed from wear or air leakage.

In the long moving blade at a turbine rear stage of the aforementioned second example of the prior art, the circumferential component of the velocity of the fluid has a tendency to establish the centrifugal force so that the flow is offset toward the outer circumference. In order to establish a flow as homogeneous as possible in the passage area for the fluid to flow smoothly in the axial direction, it is customary to make a design in which the passage area and the entrance/exit angles of the moving blade are so adjusted as to make the pressure at the entrance of the moving blade higher closer to the outer circumference and lower in the inner circumference.

As a result, in the vicinity of the root of such long moving blade, most of the pressure drop of the stage is caused in the stator blade to reduce the pressure difference between the upstream and downstream of the moving blade to an extremely low value.

Accordingly, in the aforementioned type of FIG. 9, it is difficult to retain a predetermined cooling air flow by introducing the cooling air to the blade root.

In the type of FIG. 10, too, it is impossible to expect the introduction of the cooling air at the pressure difference between the upstream and downstream of the moving blade by the cooling air having passed the labyrinth 43. As a result, most of the introduction of the cooling air depends upon the injection of the nozzle 46 so that its retention has to decrease drastically.

The invention contemplates to eliminate the defects of such examples of the prior art and to provide a structure capable of feeding the cooling air reliably to the root of the moving blade.

In order to solve the above-specified problems, according to a first invention, there is provided a gas turbine rotor, in which a plurality of discs having teeth of a bevel gear are juxtaposed to engage the teeth and are integrally fastened by a bolt extending through the discs, characterized in that there are provided on the faces of the adjoining discs arms which are made lower than the dedendums of the teeth and protruded in an annular shape to confront each other; one of the arms has a tip made to have an elastically deformable thickness and a sectional shape bent inward or outward, whereas there is welded to the other arm an extension which has a tip made to have an elastically deformable thickness and a sectional shape bent inward or outward; and that the end face of the tip of the one arm and the end face of the tip of the extension of the other arm are held in abutment against each other so that the two end faces may be forced, when the discs are integrated, into contact with each other to prevent leakage of cooling air.

According to a second invention, on the other hand, there is provided a gas turbine rotor, characterized by a sealing member for sealing the clearance to be established between the one arm and the other arm; a moving blade groove cavity formed in the outer side of the arm at the bottom of the upstream end portion of a moving blade; a stator blade upstream cavity formed on the upstream side of the inner circumferential end of a stator blade to confront the moving blade groove cavity; and a communication hole extending inside of the sealing member and axially through the one arm and the other arm to provide communication between the stator blade upstream cavity and the moving blade groove cavity.

In short, the moving blade groove cavity at the bottom of the upstream end portion of the moving blade and the stator blade upstream cavity on the upstream side of the inner circumferential end of the stator blade are made to communicate through the communication extending through the disc arms. As a result, the pressure in the moving blade groove cavity keeps the pressure in the stator blade upstream cavity substantially so that the cooling air can be reliably fed to the moving blade root succeeding the moving blade groove cavity.

BEST MODE FOR CARRYING OUT THE INVENTION

Figure 1:
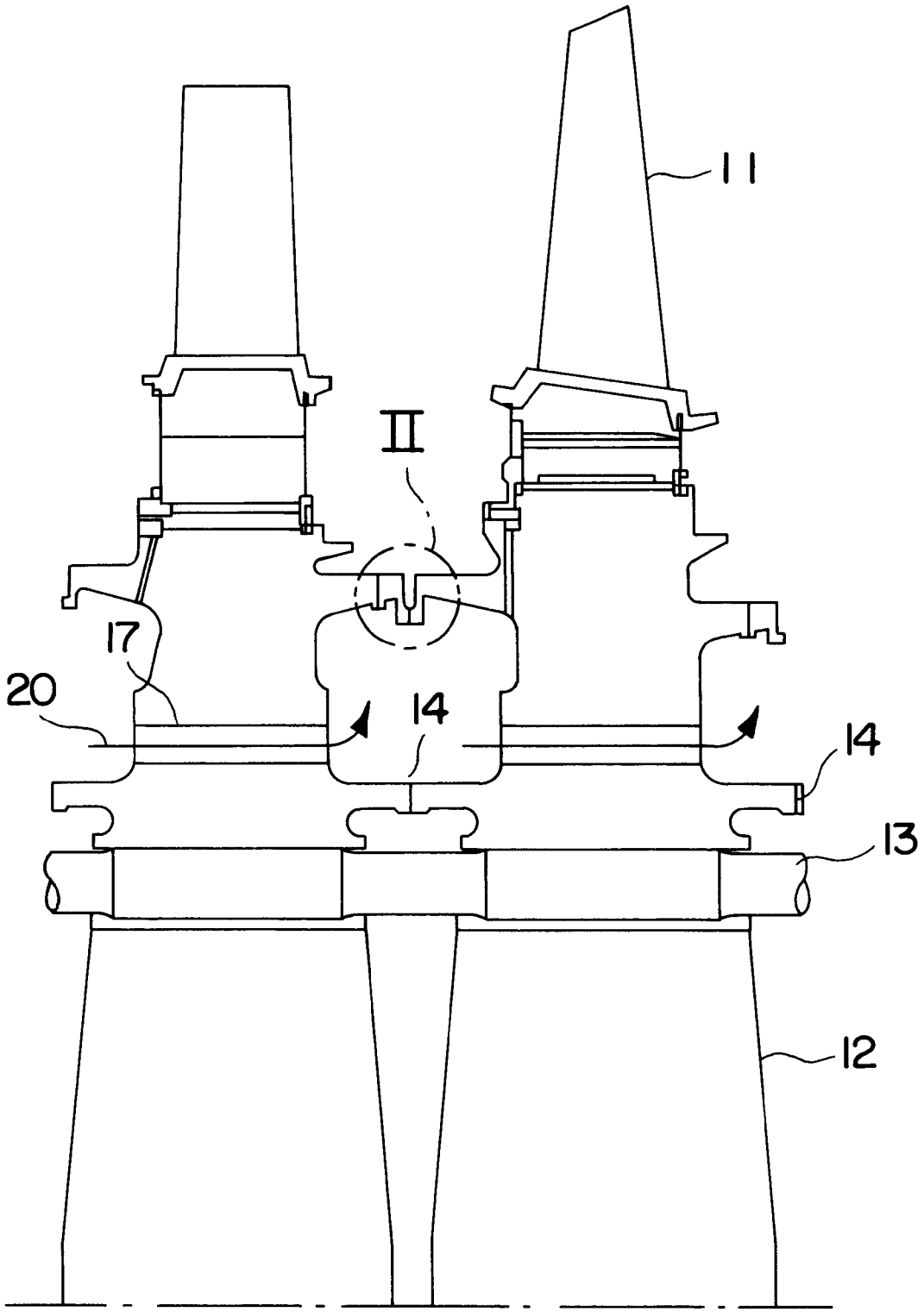
FIG. 1 is an enlarged longitudinal section of a portion of a gas turbine according to a first embodiment of the invention.

FIG. 1 is an enlarged longitudinal section of a portion of a gas turbine according to a first embodiment of the invention. In FIG. 1, the structure of an essential portion of a disc 12, teeth 14 for torque transmission between the discs, the joint of the discs by a bolt 13, and the structure of an air passage 17 or the like are identical to those of the prior art. What is different from the prior art is the structure the portion II of FIG. 1.

Figure 2:
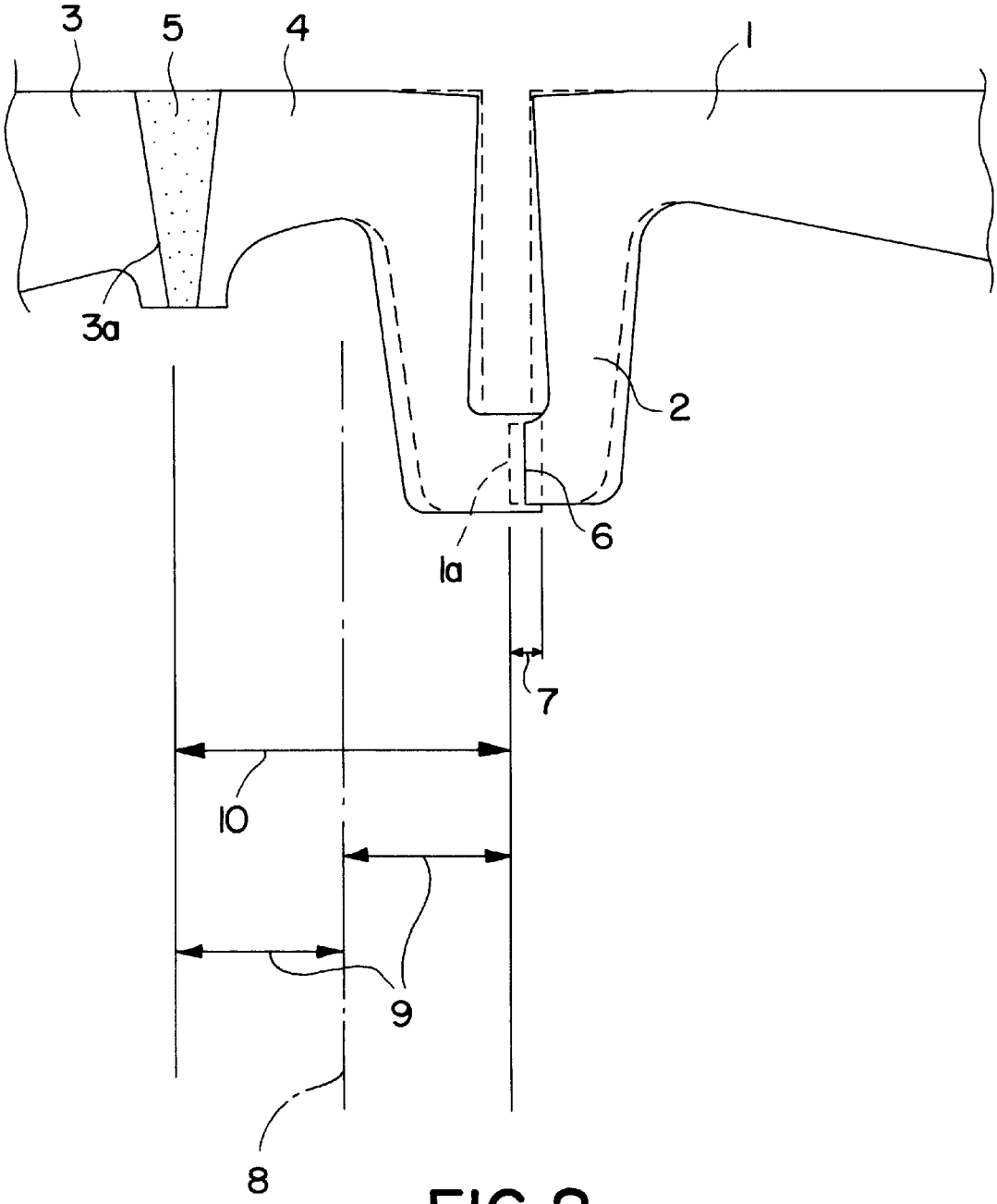
FIG. 2 is an enlarged view of a portion II of FIG. 1.

FIG. 2 is an enlarged view of the portion II of FIG. 1. In this figure, reference numeral 1 designates an arm provided at one disc. The tip 2 of this arm has an inward bent sectional shape. Numeral 3 designates an arm provided at the other disc. To this arm, there is welded an extension 4 which has an inward bent sectional shape. Numeral 5 designates a welding material. The end face of the tip 2 of one arm and the end face of the extension 4 of the other arm come into contact to construct a pressure face 6. Here, the bent portions are made to have an elastically deformable thickness. On the other hand, the tip 2 and the extension 4 may be bent outward.

Figure 4:
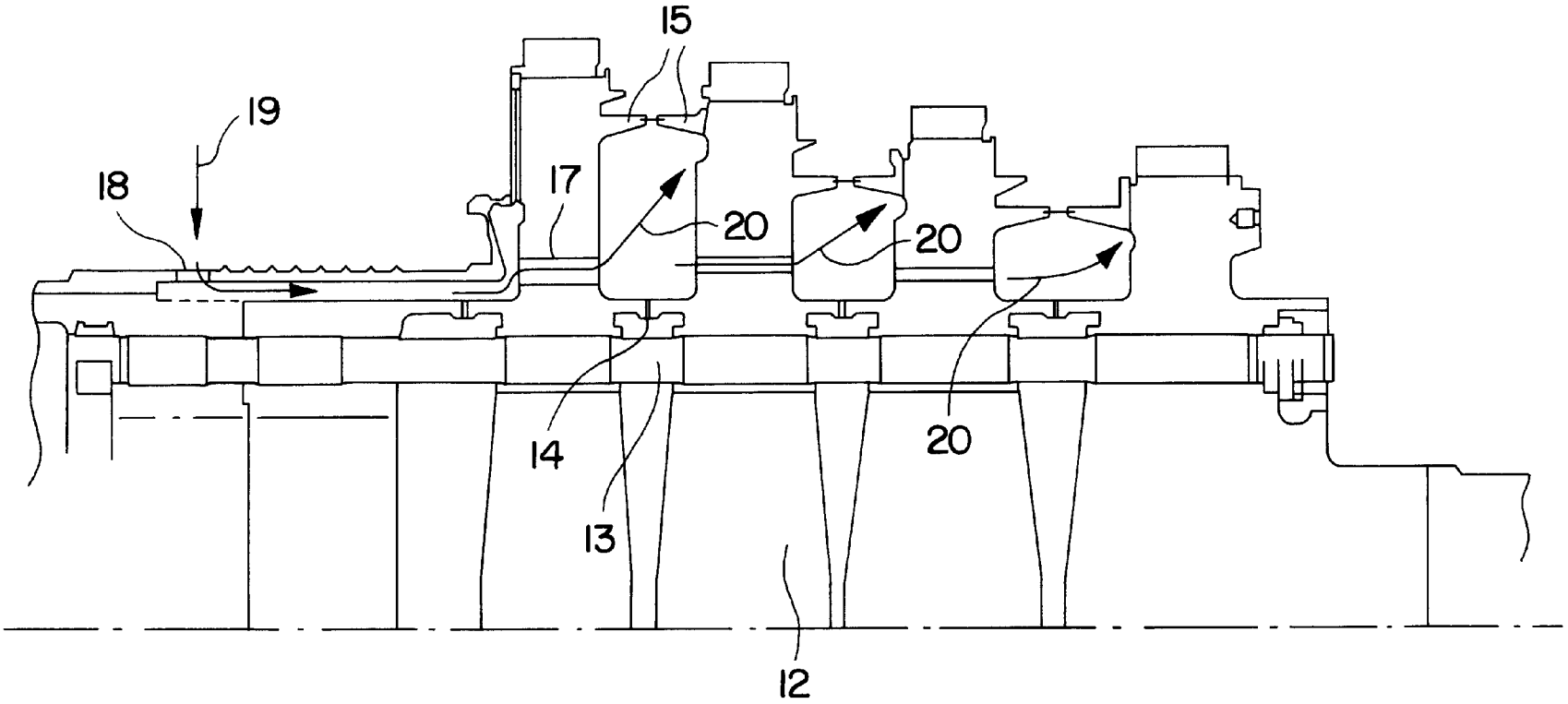
FIG. 4 PRIOR ART
FIG. 4 is a longitudinal section of a gas turbine of the prior art.
Figure 5:
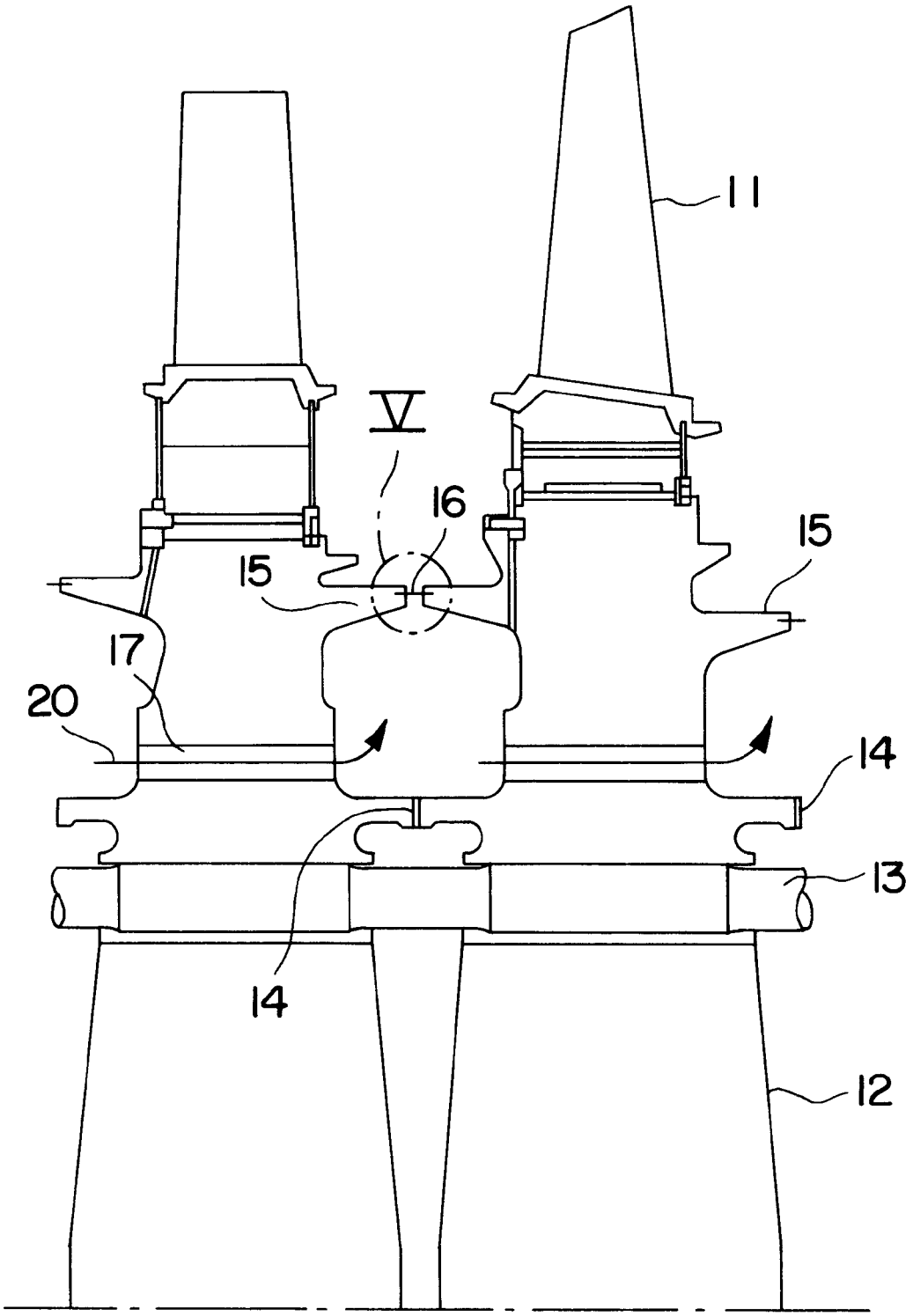
FIG.5 PRIOR ART
FIG. 5 is an enlarged longitudinal section of a portion of the above-described gas turbine.
Figure 6C:
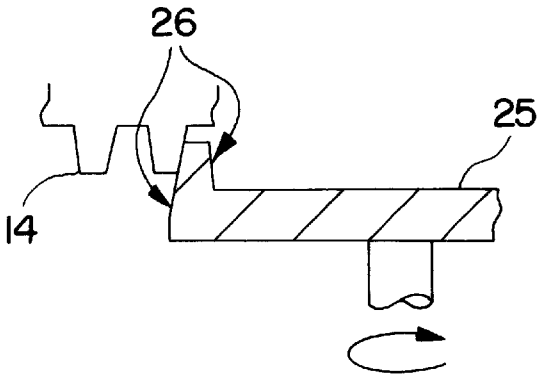
FIG. 6(c) PRIOR ART
FIG. 6 is an explanatory drawing of the working of teeth provided in a disc of the above-described gas turbine, wherein (a) is a longitudinal section of the disc, (b) is a section B—B of (a), and (c) is a section C—C of (b)
Figure 6B:
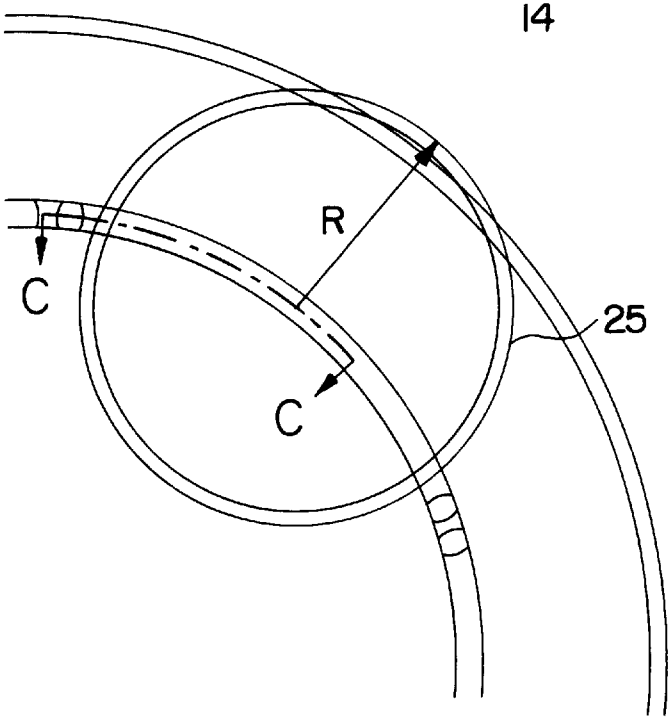
FIG. 6(b) PRIOR ART
Figure 6A:
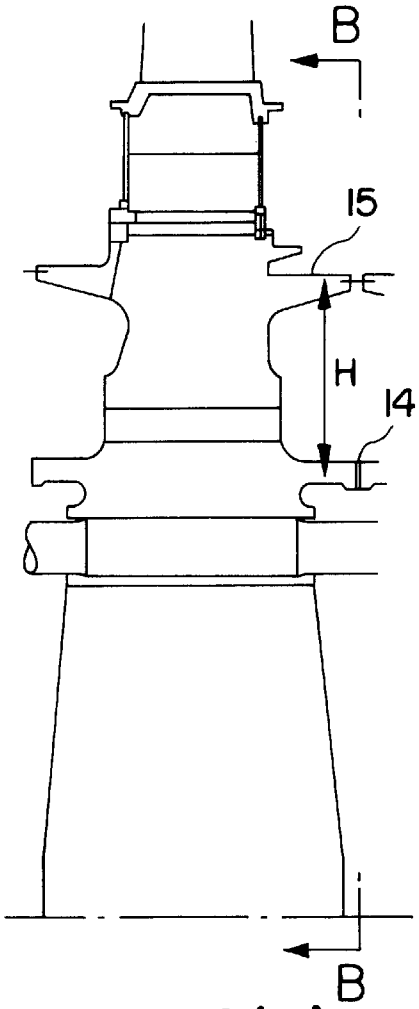
FIG. 6(a) PRIOR ART
Figure 7:
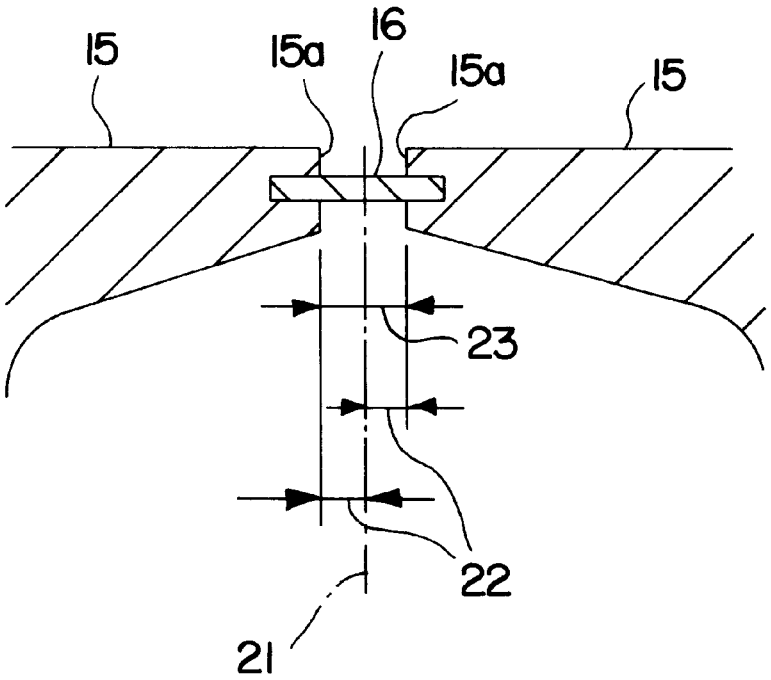
FIG. 7 PRIOR ART
FIG. 7 is an enlarged section of a disc sealing portion or the portion V of FIG. 4) of the above-described gas turbine.
Figure 8:
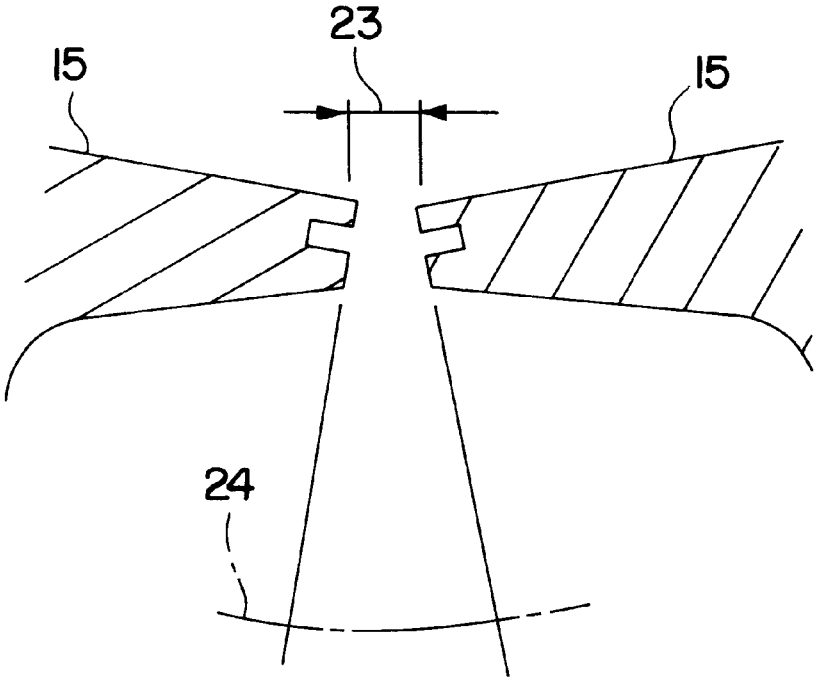
FIG. 8 PRIOR ART
FIG. 8 is a section explaining a deformed state of the above-described sealing portion.
Figure 9:
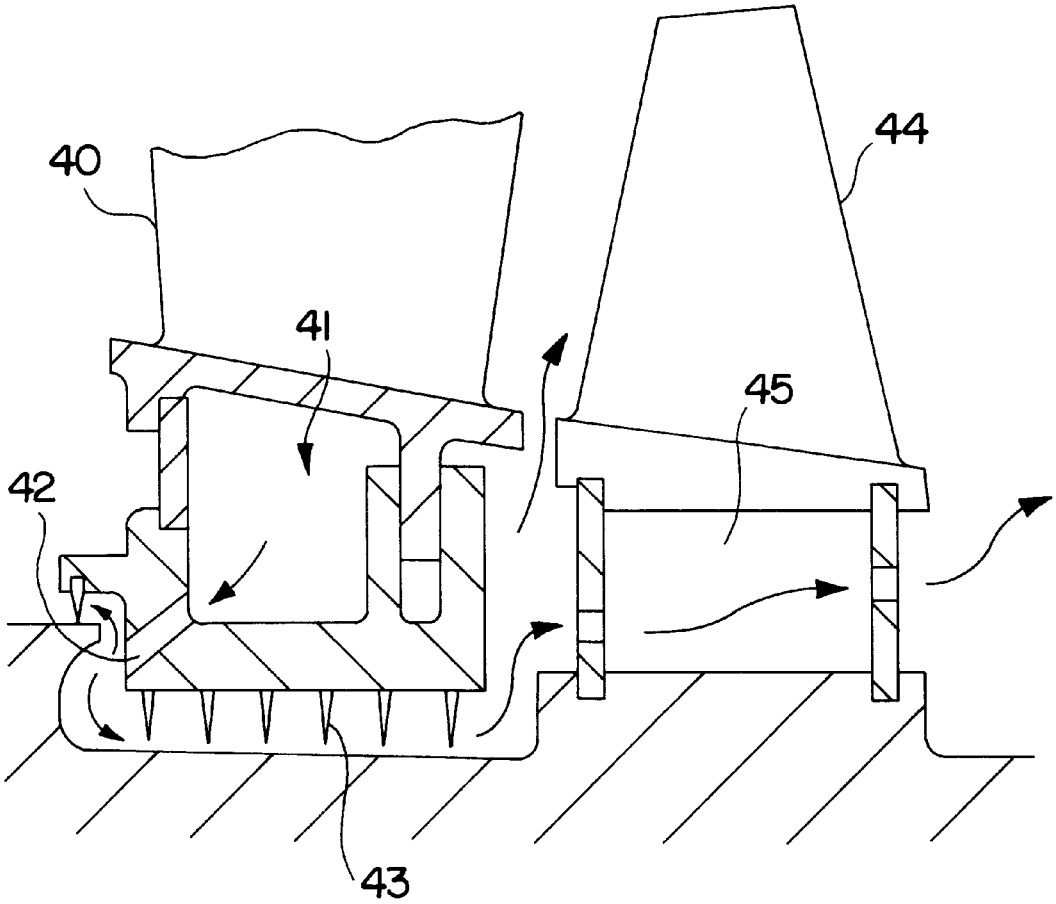
FIG.9 PRIOR ART
FIG. 9 is an explanatory section showing another example of an essential portion of the gas turbine rotor of the prior art.
Figure 10A:
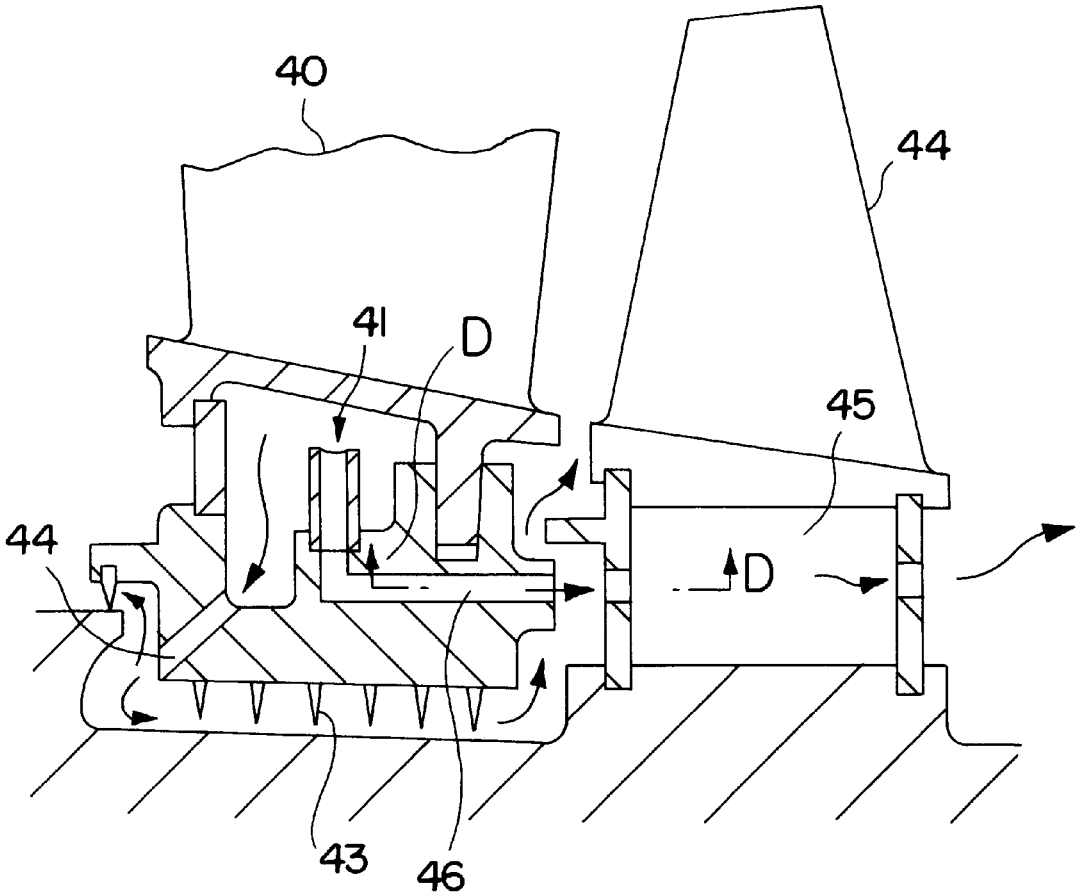
FIG. 10(a) PRIOR ART
FIG. 10 is an explanatory drawing to show a still another example of an essential portion of the gas turbine rotor of the prior art, wherein (a) is an explanatory section of the essential portion, and (b) is a section D—D of (a).
Figure 10B:
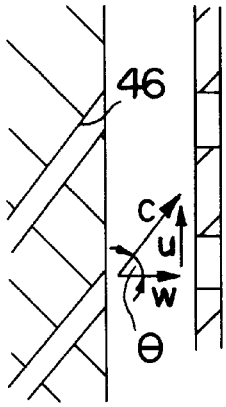
FIG. 10(b) PRIOR ART

In FIG. 2, solid lines indicate the actually used state, in which the two arms are forced to contact with each other on the pressure face 6. What is indicated by broken lines is the state, in which the partner has no arm, i.e., the unloaded state at the initial time of the manufacture. The tip of the arm 1 and the extension 4 are forced to contact with each other so that they are elastically deformed. Numeral 7 designates a distance between the end faces of the initial shape, that is, a pressure allowance to be considered at the manufacturing time. Numeral 8 designates a pitch line of the gears engaging for the torque transmission, as shown in FIG. 1 (or in FIG. 4 of the prior art), and numeral 9 designates a relief for the grinding stone to work the dedendums of the teeth. The end face 1*a* of the aforementioned one arm 1 and the end face 3*a* of the other arm 3 are formed at positions retracted sufficiently from the limit line of the relief 9 of the grinding stone, so that the teeth can be worked. A distance 10, as left inbetween, is buried by the welded extension 4 of the other arm.

In the structure of the gas turbine rotor of the first embodiment thus far described, little sliding motion is on the pressure face 6 so that no wear occurs. As the rotor rotates, on the other hand, its weight warps the center line, and the disc clearance changes over and under the center line so that the pressure changes periodically on the pressure face 6 of the tip of the aforementioned arm. However, the forced contact is unchanged to prevent the air leakage.

A second embodiment of the invention is described with reference to FIG. 3.

Figure 3A:
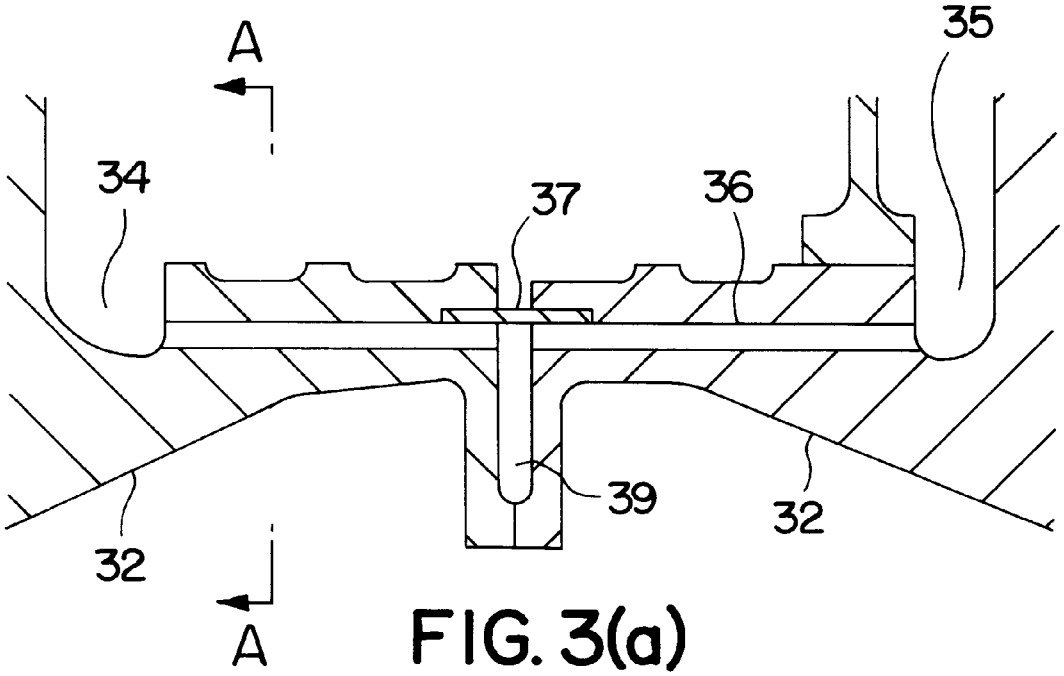
FIG. 3 shows an essential portion of a gas turbine rotor according to a second embodiment of the invention, wherein (a) is an enlarged view of a joint portion of a disc arm, and (b) is a section of a portion A—A of (a)
Figure 3B:
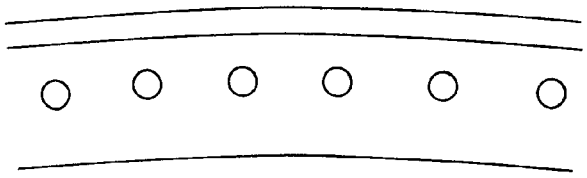

FIG. 3 show an essential construction of this embodiment separately at (a) and (b).

Here, a pair of adjoining discs 32, 32 are held in contact with each other and positioned relative to each other.

In the figure, the lefthand side is located on the upstream side of the working fluid, on which a stator blade upstream cavity 34 is formed at a position to correspond to the overhand of the disc arm 32.

Downstream of the working liquid, as located on the righthand side, a moving blade groove cavity 35 which is located at bottom of the upstream end portion of the moving blade to confront the stator blade upstream cavity 34.

In the paired disc arms 32, 32 which are extended axially toward each other to abut at their tips against each other, there is formed a communication hole 36 which extends axially through the disc arms 32, 32 to provide the communication between the stator blade upstream cavity 34 and the moving blade groove cavity 35.

Here, the paired disc arms 32, 32 are held in abutment against each other through a partial space 39, as shown, aiming at an elastic abutment. In order that the communication hole 36 is not opened via the space 39, a sealing plate 37 is arranged in the circumferential direction.

With the construction of this embodiment thus far described, the cooling air, as carried through the stator blade (not shown) to the stator blade upstream cavity 34, is fed via the communication hole 36 to the moving blade groove cavity 35.

The communication hole 36 has no special obstruction so that it passes the cooling air without a substantial pressure loss. As a result, the moving blade groove cavity 35 is fed with the cooling air under a pressure substantially equal to that in the stator blade upstream cavity 34.

In other words, no pressure loss is made between the upstream and downstream sides of the stator blade (not shown) so that the pressure on the upstream side of the stator blade is brought as it is as the pressure on the upstream side of the moving blade arranged at the downstream position.

Accordindgly, at the feed of the cooling air from the moving blade groove cavity 35 to the root of the moving blade not shown), the pressure substantially corresponding to that in the stator blade upstream cavity is made to act as the entrance pressure of the moving blade root so that the cooling air can be fed without fail.

Although the invention has been described in connection with its shown embodiments, it should not be limited thereto but could naturally be modified in its specific structures in various manners within the scope thereof.

INDUSTRIAL APPLICABILITY

In the gas turbine rotor thus far described according to the first invention, there are provided on the faces of the adjoining discs arms which are made lower than the dedendums of the teeth and protruded in an annular shape to confront each other; one of the arms has a tip made to have an elastically deformable thickness and a sectional shape bent inward or outward, whereas there is welded to the other arm an extension which has a tip made to have an elastically deformable thickness and a sectional shape bent inward or outward; and the end face of the tip of the one arm and the end face of the tip of the extension of the other arm are held in abutment against each other so that the two end faces may be forced, when the discs are integrated, into contact with each other. The forced faces of the two end faces neither substantially slide nor wear, but the both end faces are forced to contact so that they can prevent the air leakage.

According to the second invention, the gas turbine rotor is constructed so as to comprise a sealing member for sealing the clearance to be established between the one arm and the other arm; a moving blade groove cavity formed in the outer side of the arm at the bottom of the upstream end portion of a moving blade; a stator blade upstream cavity formed on the upstream side of the inner circumferential end of a stator blade to confront the moving blade groove cavity; and a communication hole extending inside of the sealing member and axially through the one arm and the other arm to provide communication between the stator blade upstream cavity and the moving blade groove cavity. As a result, a pressure corresponding to the pressure in the stator blade upstream cavity can be kept in the moving blade groove cavity and used as the pressure on the moving blade upstream side to force the cooling air to the blade root downstream of the moving blade groove cavity. Thus, it is possible to ensure and stabilize the feed of the cooling air thereby to advance the countermeasure, for the high temperature of the gas turbine drastically.

What is claimed is:

1. A gas turbine rotor, in which a plurality of discs having teeth of a bevel gear are juxtaposed to engage said teeth and are integrally fastened by a bolt extending through said discs, wherein there are provided on the faces of the adjoining discs arms which are made lower than the dedendums of said teeth and protruded in an annular shape to confront each other; one of said arms has a tip made to have an elastically deformable thickness and a sectional shape bent inward or outward, whereas there is welded to the other arm an extension which has a tip made to have an elastically deformable thickness and a sectional shape bent inward or outward; and that the end face of the tip of said one arm and the end face of the tip of the extension of said the other arm are held in abutment against each other so that said two end faces may be forced, when said discs are integrated, into contact with each other to prevent leakage of cooling air.

2. A gas turbine rotor as set forth in claim 1, comprising a sealing member for sealing the clearance to be established between said one arm and said the other arm; a moving blade groove cavity formed in the outer side of said arm at the bottom of the upstream end portion of a moving blade; a stator blade upstream cavity formed on the upstream side of the inner circumferential end of a stator blade to confront said moving blade groove cavity; and a communication hole extending inside of said sealing member and axially through said one arm and said other arm to provide communication between said stator blade upstream cavity and said moving blade groove cavity.

* * * * *